US006345723B1

(12) United States Patent
Blake et al.

(10) Patent No.: US 6,345,723 B1
(45) Date of Patent: Feb. 12, 2002

(54) UPRIGHT AND INVERTED BOTTLE AND CONTAINER HOLDER FOR CONTENTS AVAILABILITY

(76) Inventors: Vance G. Blake, 3790 Cracker Way, Bonita Springs, FL (US) 34134; Stuart P. Whitcomb, 375 SW. 88th Ave., Portland, OR (US) 97225

( * ) Notice: Subject to any disclaimer, the term of this patent is extended or adjusted under 35 U.S.C. 154(b) by 0 days.

(21) Appl. No.: 09/583,926

(22) Filed: May 31, 2000

(51) Int. Cl.[7] ..... A47F 7/00

(52) U.S. Cl. ..... 211/74; 211/73; D6/545; 248/311.3; 248/314; 248/205.3

(58) Field of Search ..... 211/72, 73, 74, 211/75; 248/205.2, 205.3, 311.2, 311.3, 314, 315, 152, 316.1, 316.8; D6/545

(56) References Cited

U.S. PATENT DOCUMENTS

| | | | | | |
|---|---|---|---|---|---|
| 1,810,836 | A | * | 6/1931 | Laubenstein | |
| 2,773,480 | A | * | 12/1956 | Kosher | |
| 3,193,232 | A | * | 7/1965 | Hatcher | |
| 4,271,878 | A | | 6/1981 | Bologa | |
| 4,305,512 | A | * | 12/1981 | Mackenzie | 211/75 |
| D264,954 | S | * | 6/1982 | Blackburn | |
| 4,424,906 | A | * | 1/1984 | Richmond | 211/73 X |
| 4,971,209 | A | | 11/1990 | Todd | |
| 5,071,002 | A | * | 12/1991 | Bradley | 211/72 X |
| 5,439,193 | A | | 8/1995 | Coulter et al. | |
| 5,655,673 | A | * | 8/1997 | Weterrings et al. | 211/75 |
| 5,664,753 | A | | 9/1997 | Takei | |
| 5,702,009 | A | | 12/1997 | Ouellet et al. | |
| 5,704,495 | A | | 1/1998 | Bale et al. | |
| 5,794,904 | A | | 8/1998 | Hackley | |
| 5,950,698 | A | | 9/1999 | Cristea et al. | |
| 6,073,899 | A | * | 6/2000 | Omrani | 248/311.2 |
| 6,156,275 | A | * | 12/2000 | Dumitrescu et al. | 211/74 X |

* cited by examiner

*Primary Examiner*—Robert W. Gibson, Jr.
(74) *Attorney, Agent, or Firm*—Edward M. Livingston, Esq.

(57) ABSTRACT

A storage holder (1, 13, 20, 24) for holding bottles and containers in an upright or inverted orientation as necessary to make the liquid contents readily available for use. The holder has a base section (3, 14, 25, 36, 40) for supporting bottles and containers in an upright position and an opening to insert and surround a cap when holding a bottle or container in an inverted orientation. A back section (4, 15, 21,26, 44) connected to the base section provides wall mounting capability. One embodiment of the holder may have a front section (6, 16, 32, 38, 41) to securely maintain a bottle or container between the front and back sections. The front section may be at least one flexible and curvilinear piece to hold various sizes and shapes of bottles and containers in a spring-like manner between the front and back sections. The holder may also have a top section (5, 19, 27) having an opening for inserting and supporting an upper portion of a bottle or container. Both single and multiple bottle and container holders are provided. An optional draining and serving tray (31) in the base section is also disclosed.

11 Claims, 3 Drawing Sheets

UPRIGHT AND INVERTED BOTTLE AND CONTAINER HOLDER FOR CONTENTS AVAILABILITY

BACKGROUND OF THE INVENTION

This invention relates to container holding devices and more particularly, a device that not only allows containers to be held in an upright position but also an inverted position when necessary and as desired to make the contents of the container readily available for use.

When using most bottles or containers, whether such containers contain shampoo, hair conditioner, ketchup, liquid butter, or other liquid, it is often difficult to expel the contents. The bottle or container must often be held upside down and shaken for the contents to drain from the inside of the container to the spout to be available for use. The latter procedure takes patience and can be frustrating. Even when following such a procedure in most cases the entire residual contents of the container are not used and the container is thrown away, thereby wasting the residual contents. Although some bottles or containers have caps shaped so the bottle can be placed and held inverted so the contents are always available for use, most containers are made with rounded caps or dispensing nozzles, whether by design or otherwise so they will not remain in an inverted position during storage so the contents will be readily available for use.

Thus, a need exists for a bottle or container holding device that can hold a wide variety of shapes and sizes of containers in either an upright or inverted position to make the entire contents readily available for use when needed.

The prior art includes some inverted container holders, but none holds bottles or containers in either or both upright or inverted positions in a secure manner as does the present invention. For instance, U.S. Pat. No. 5,439,193 issued to Coulter, et al. on Aug. 8, 1995, discloses an inverted container support which holds a container around the cap and has suction cups to hold it against the wall. However, the container can only be held in an inverted position and the holder does not provide any support for the body of the container, thereby making it susceptible to tipping. U.S. Pat. No. 5,702,009 issued to Ouellet, et al. on Dec. 30, 5 1997, discloses a holder which supports various sizes of bottles in an inverted position to collect the residual contents in the bottom of the cubical holder. U.S. Pat. No. 4,971,209 issued to Todd on Nov. 20, 1990 discloses another inverted bottle container holder having holes which wrap around only the bottle cap. U.S. Pat. No. 5,704,495 issued to Bale, et al. on Jan. 6, 1998, discloses a device for holding a plurality of the same size bottles in an inverted position. U.S. Pat. No. 5,794,904 issued to Hackley on Aug. 18, 1998, discloses a two piece holder for holding an inverted bottle with a bottom piece that holds the bottom around the cap and top funnel-like piece that supports only part of the body near the cap. U.S. Pat. No. 4,271,878 issued to Bologa on Jun. 9, 1981 discloses a holder that has an opening into which the top of an inverted bottle can be inserted and held in an elevated position so the contents can be drained into a container. U.S. Pat. No. 5,664,753 issued to Takei on Sep. 9, 1997, teaches another bottle holder for an inverted container which has an opening to hold a container in the cap. Finally, U.S. Pat. No. 5,950,698 issued to Cristea, et al. on Sep. 14, 1999, discloses another inverted container holding device having two conical pieces.

Thus, although there are many patented devices for holding containers or bottles in an inverted position, none allows the bottles or containers to be held in either or both an upright or inverted position as needed and when desired in a secure manner as does the present invention.

SUMMARY OF THE INVENTION

The primary object of the present invention is to provide a secure bottle and container holding device that makes the contents of the bottle or container readily available for use when needed.

Another object of the present invention is to provide such a device that eliminates waste by making the residual contents of a bottle readily available for use.

A further object of the present invention is to provide such a device that allows a bottle or container to be held securely in either or both an upright or inverted position as desired during storage.

An additional object of the present invention is to provide such a device that can rest on a flat surface, such as counter or table, or be mounted to a vertical surface, such as a wall.

An even additional object of the present invention is to provide a bottle and container holding device that can hold a plurality of bottles and containers having different shapes and sizes.

An optional object of the present invention is to provide a bottle and container holding device that allows the residual contents of the bottle or container to be drained for use.

The present invention fulfills the above and other objects by providing bottle and container holding devices that have a base for maintaining the holder in a upright position, a top section having an opening into which a container is placed and held securely in either an upright or inverted vertical position, a back side which connects the base and the top sections and a front side for holding the bottle or container between the front and back sides. The base section may have an opening of sufficient size to retain a cap of a bottle and container when the container is in an inverted position. The back section may contain means for mounting the holder to a wall, those means consisting of foam wall mount tape, hook and loop fastening material, holes for screws and nails or other fastening means. The top section has an opening between a front and a back that is shaped to hold either a round or rectangular shaped bottles and containers. Although the front section may be incorporated as part of the top section, it may also comprise a curvilinear piece attached which extends vertically upward from the base section that is curved inward toward the back section so it acts as a leaf spring to hold a container firmly in place between the back and front sections of the device. The holding device of the present invention may be designed to hold only one bottle or container or to hold multiple containers of various sizes and shapes in various inverted and upright positions as necessary and depending on the contents. The present invention also provides for a drain tray to be held in the base section between a lower base plate and an upper base plate so that the cap can be removed and the residual contents drained into the tray for use.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
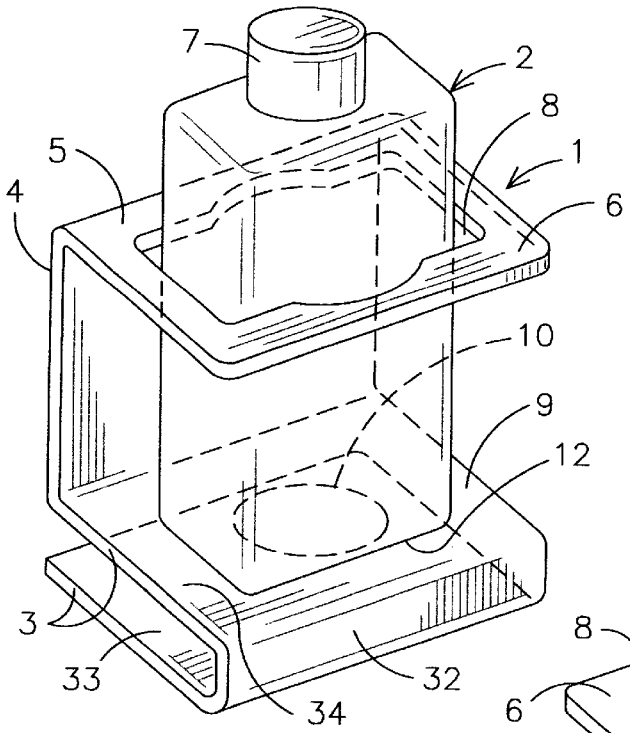
FIG. 1 is a front perspective plan view of the holding device with a bottle or liquid container being held in an upright position.
Figure 2:
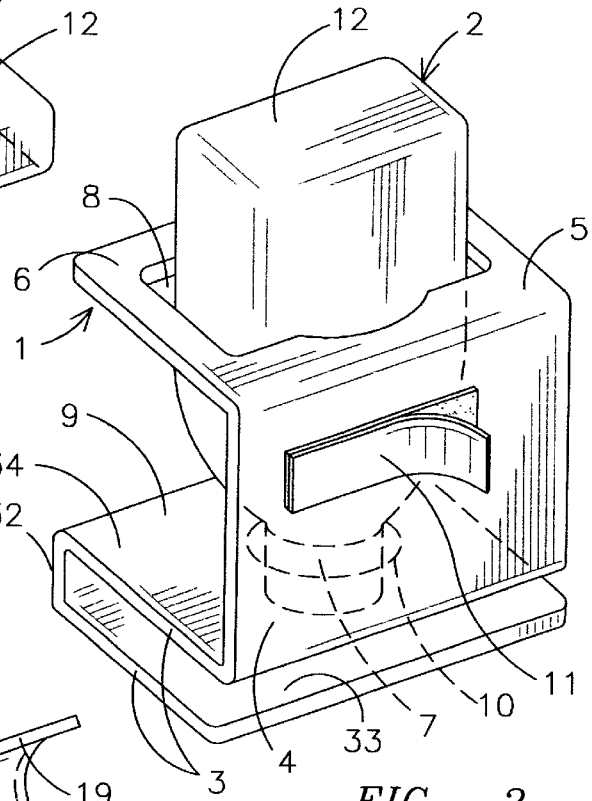
FIG. 2 is a rear perspective plan view of a holding device with a bottle or liquid container being held in an inverted position.

For purposes of describing the preferred embodiment, the terminology used in reference to the numbered components in the drawings is as follows:

1. container holder
2. container
3. base section of holder
4. back section of holder
5. top section of holder
6. front section of holder
7. cap of container
8. opening for bottle
9. cap holding plate
10. opening for caps
11. mounting tape
12. bottom of container
13. container holder
14. base plate
15. back plate
16. front plate
17. optional cap holder
18. mounting tape
19. top of front plate
20. multiple container holders
21. common back section
22. mounting holes
23. various containers
24. container holder
25. elevated section base
26. back
27. top
29. cap opening
30. bottle opening
31. drain tray
32. front plate
33. lower plate of base section
34. upper plate of base section
35. top opening
36. common base section
37. graphics front panel
38. front leg
39. rear leg
40. base section
41. front plate
42. rod
43. rod grasper
44. back section
45. open top section Referring to the drawings, all of the drawings show a somewhat ribbon-shaped holding device that by virtue of its form can either hold a container securely in an upright or inverted position. In FIGS. 1 and 2 the container holder 1 is shown holding a liquid contents container 2 in either an upright position as in FIG. 1 or an inverted position as in FIG. 2. The container holder has a base section 3 to support the bottom or top of a container 2. A top section 5 which has an opening 8 between sides which wraps around the container 2, which in turn is connected to the base section 3 by a vertical back section 4. As shown in FIGS. 1 and 2, the base section 3 may have a lower plate 33 for resting on a flat surface with an upper plate 34 connected to the lower plate by a front section 32. The latter design allows the cap 7 of the container 2 when held in the inverted position as shown in FIG. 2 to be placed in the cap hole 10 in the upper plate 34, thus providing a secure way to keep the container from tipping or falling when being held in an inverted position. The opening 8 in the top is shaped so it can hold either a round or rectangular bottles or containers. The back section of the holder 4 may contain mounting means, such as a foam wall mount tape 11 as shown, hook and loop fastening material, other adhesive means, or even contain holes for inserting nails or screws.

Figure 3:
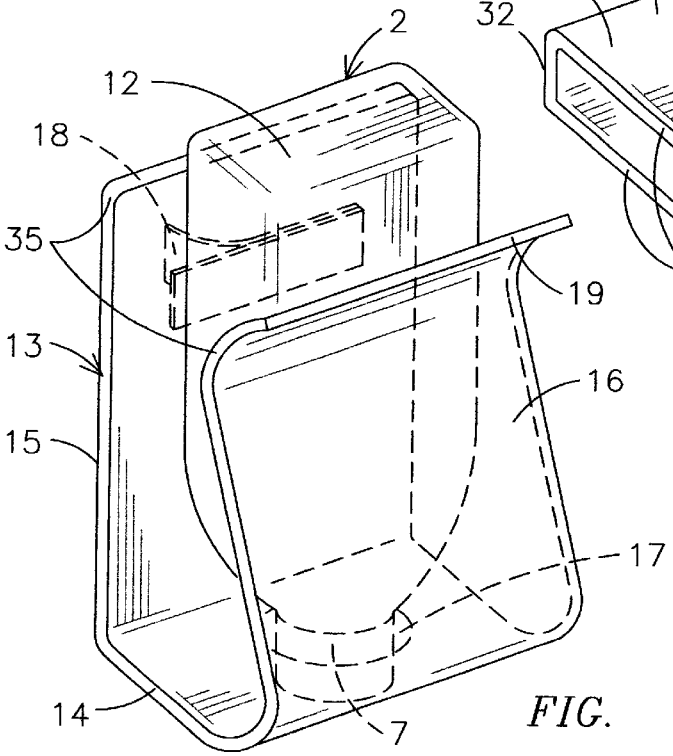
FIG. 3 is a front perspective plan view of another embodiment of the container holder with a bottle or liquid container in an inverted position.

FIG. 3 illustrates another embodiment 13 of the present invention which also has a base section 14, a back section 15, a top section 19 and front section 16. In this embodiment the base section 14 is shown as having only one plate for placing the device on a planar surface, such as a counter. The base section 14 may have an opening 17 to lodge the cap 7 of the container 2 when held in the inverted position. The front section 16 has a curvilinear shape with an upper section 19 being curved inward toward the container 2 so as to act as a leaf spring to hold the container firmly in place. The top section 19 of the front section may be curved outward to make it easier to insert the bottle or container. The top opening 35 varies in width due to the flexibility of the front and back sections 16 and 15 so as to hold various sizes and shapes of bottles or containers. The back section will contain mounting means 18 as previously discussed with relation to FIGS. 1 and 2 to attach the container holder to a wall surface if desired.

Figure 4:
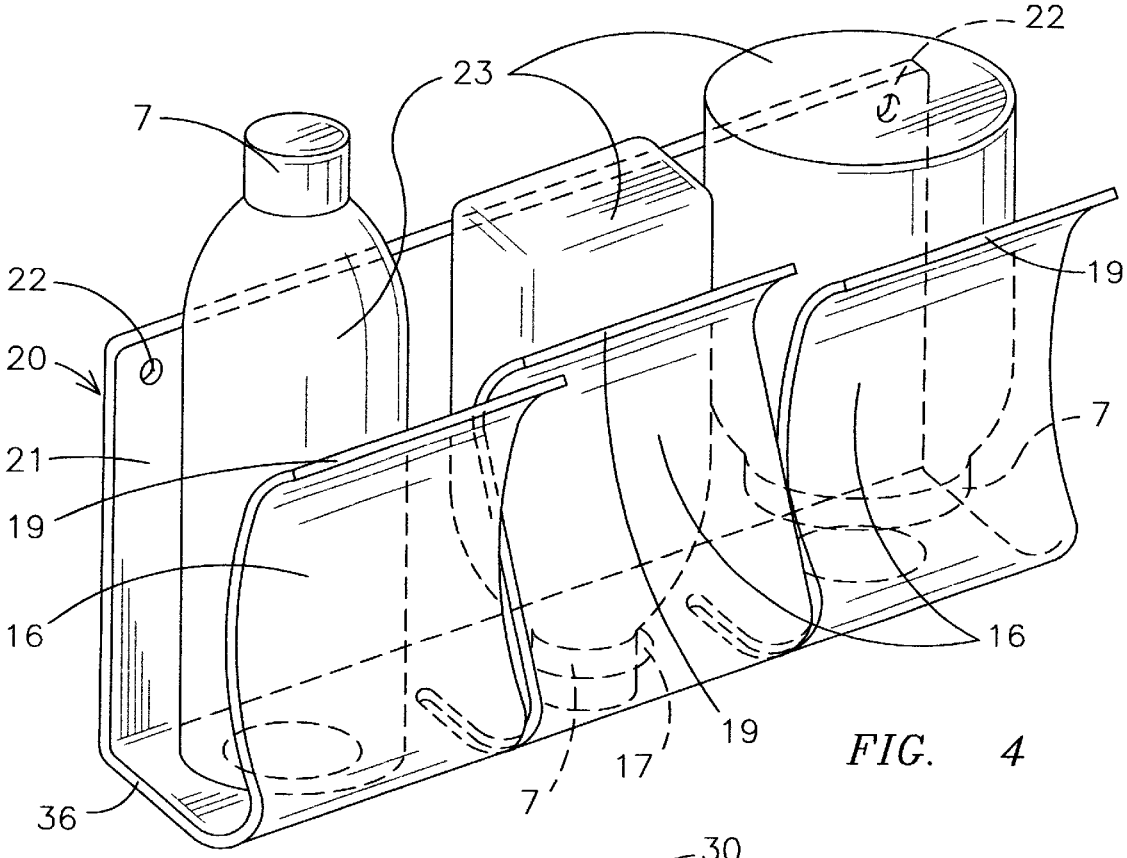
FIG. 4 is a front perspective plan view of a multiple bottle or liquid container holders of multiple sizes and shapes being held in various upright and inverted position.

FIG. 4 shows the embodiment of FIG. 2 designed to hold a plurality of bottles and containers having various shapes and sizes in a variety of upright or inverted positions. In this embodiment the holding device 20 has a back section 21 which is common to all bottles and containers being held in a common base section 36. However, the front sections 16 are separate for each container or bottle so the front sections 16 can flex sufficiently to provide a top opening to hold the containers or bottles 23 firmly in a spring-like manner between the front section 16 and back section 21. The base section 36 may have optional cap openings 17 to hold the cap 7 of the containers 23 when the containers are held in an inverted position. As with the other embodiments, this device can also be placed on a planar surface, such as a table or counter, by resting it on its base section 36 or it can be mounted to a wall by mounting means using screws or nails to be inserted through the holes 22 in the back section 21 to a wall surface as shown.

Figure 5:
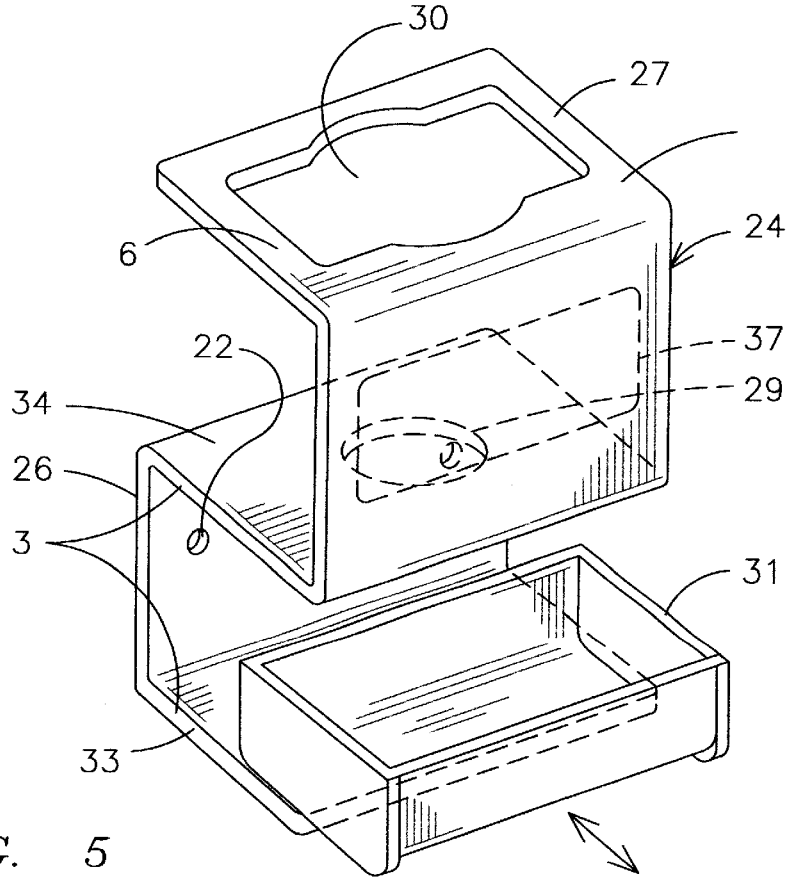
FIG. 5 is a front perspective plan view of a bottle and container holder having a tray in the base section for draining and serving the residual contents of the container.

In FIG. 5 another embodiment of the container holder is shown having a base section 3, back section 26, top section 27 and front section 6. This container holder 24 has features common to the other embodiments illustrated, such as a top bottle or container holding opening 30 having a rectangular shape with front and back cutouts for holding round or rectangular bottles, a cap holding opening 29 and a base section 3 having lower holding plates. However, this embodiment has in addition a pull tray 31 which slides in and out in the base section between lower and upper plates 33 and 34 of the base section. Thus, the bottle cap may be removed from the bottle and the contents allowed to drain from the container into the pull tray 31. Then the pull tray 31 can be slid out from the base section 3 and the contents used. This embodiment would be particularly useful when the viscosity of the liquid in the container makes it extremely difficult for the residual contents from the bottle or container in a short time period. A front panel 37 is also provided for placing graphics as desired. A back panel 26 is shown for wall mounting the device using screws through holder 22 or with wall-mounting tape.

Figure 6:
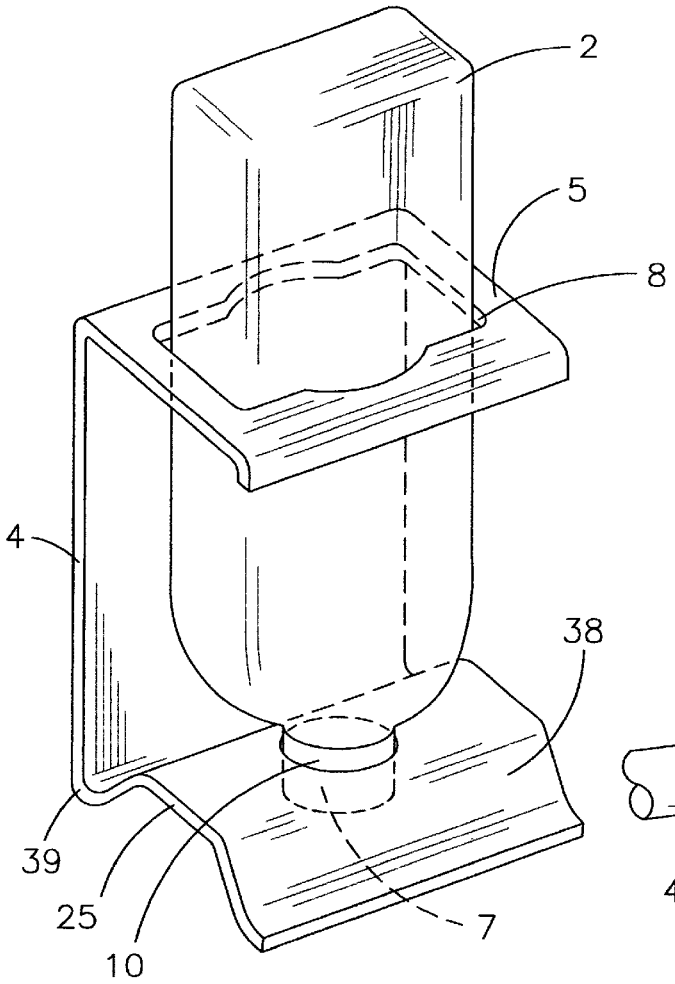
FIG. 6 is a front perspective plan view of another embodiment of a bottle and container holder having an elevated base section.

FIG. 6 illustrates another embodiment of a bottle and container holder having a single base section 25 which is elevated in the middle by a slanted front leg 38 and rear leg 39 so as to elevate the bottle 2 sufficiently to allow the cap 7 to rest in the bottle hole 10. A back section 4 rises from the rear leg 39 to a top section 5 which has an opening 38 into which the bottle is inserted and held securely in place during storage of the bottle.

Figure 7:
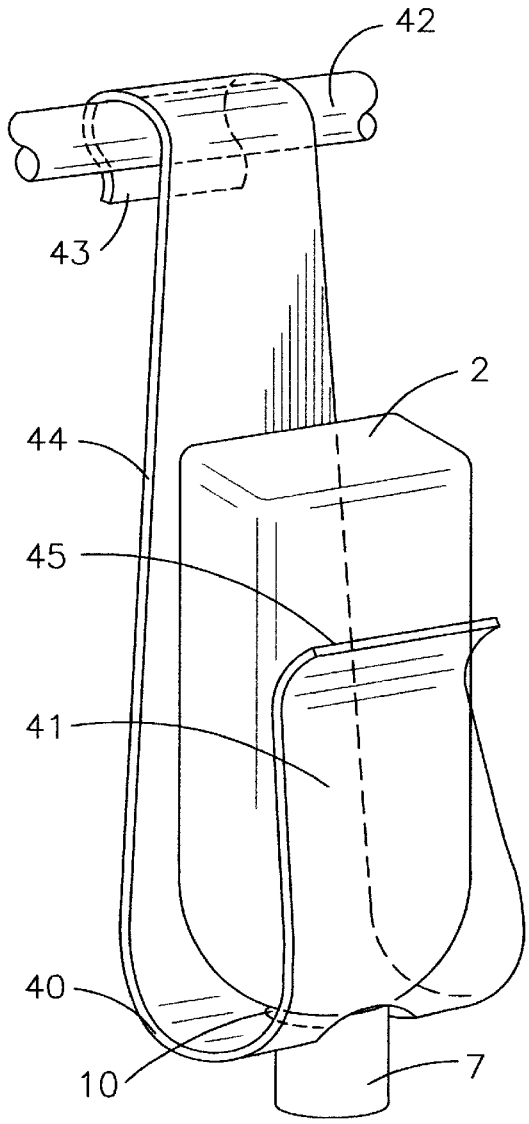
FIG. 7 is a front perspective plan view of a rod hanging embodiment of a bottle and container holder.

FIG. 7 a rod hanging version of a bottle holder is shown. This version has a curved base section containing a cap hole 10 for inserting and holding the bottle cap 7, an open top section 45 into which the bottle 2 is inserted between a flexible front plate 41 for the bottle 2 and a back section 44 and a top substantially U-shaped rod grasper 43 for attaching the holder to a rod 42, such as a towel or curtain rod.

In summary, as illustrated by the preferred embodiments, the present invention provides a bottle container holding device that holds various sizes and shapes of bottles and containers in either or both an upright or inverted position in a firm and secure manner. Unlike other holding devices in the prior art, the present invention allows one to store a bottle or container in an upright position when it is new and there is no problem removing the contents from the container. Then as it becomes more difficult to remove the contents, especially as the bottle or container becomes less full, the bottle or container can be stored in an inverted position.

The holding device of the present invention can easily be made of almost any rigid material, such as clear or colored acrylic, other plastic or metal, which is bended into the desired shape, or made by injection molding.

Although only a few embodiments of the present invention have been described in detail hereinabove, all improvements and modifications to this invention within the scope or equivalents of the claims are included as part of this invention.

We claim:

1. A holder for bottles and containers comprising:

a base section for supporting a bottle or container in an upright position having an opening slightly larger than a cap or spout of the bottle or container in order to surround or retain the cap or spout when the bottle or container is held in an inverted position; and a back section connected to the base section, wherein the base section comprises a first lower plate that rests on a planar surface and a second plate connected above it, said second plate having a hole to retain the cap or spout of the bottle or container when held in an inverted position.

2. The holder of claim 1 wherein the base section contains a pull out drain tray between the lower and upper plates so when the cap of the bottle or container is removed the contents of the bottle or container can be drained into the pull out tray and used as needed.

3. A holder for bottles and containers comprising:

a base section for supporting a bottle or container in an upright position having an opening slightly larger than a cap or spout of the bottle or container in order to surround or retain the cap or spout when the bottle or container is held in an inverted position; and a back section connected to the base section; and a front section connected to the base section for enclosing the bottle or container between said front section and back sections, wherein the front section comprises at least one curvilinear piece attached at a bottom to the base section, said piece extending vertically upward having a top portion that is curved inwardly toward the back section so as to act like a leaf spring to hold the bottle or container firmly in place.

4. The holder of claim 3 wherein the top portion of the front section extends outward from the back side to allow a bottle or container to be guided more easily between the front and back sections.

5. The holder of claim 3 wherein at least one curvilinear piece allows a plurality of bottles and containers to be held between the front section and back section, said bottles and containers being of various sizes and shapes held in various upright and inverted positions.

6. The holder of claim 4 wherein the at least one curvilinear piece allows a plurality of bottles and containers to be held between the front section and back section, said bottles and containers being of various sizes and shapes held in various upright and inverted positions.

7. The holder of claim 1 wherein the back section contains means for mounting the holder to a rod.

8. The holder of claim 1 further comprising a top section connected to the back section, said top section having an opening into which a bottle or container can be inserted.

9. The holder of claim 8 wherein the opening in the top section of the holder is sized and shaped to hold round or rectangular shaped bottles and containers of various sizes.

10. The holder of claim 2 further comprising a top section connected to the back section, said top section having an opening into which a bottle or container can be inserted.

11. The holder of claim 10 wherein the opening in the top section of the holder is sized and shaped to hold round or rectangular shaped bottles and containers of various sizes.

* * * * *